US007178306B2

(12) United States Patent
Fritz

(10) Patent No.: US 7,178,306 B2
(45) Date of Patent: Feb. 20, 2007

(54) SINGLE PLY ROOFING SYSTEMS AND METHODS OF CONSTRUCTING THEM

(75) Inventor: Todd D. Fritz, Burton, MI (US)

(73) Assignee: Duro-Last, Inc., Saginaw, MI (US)

( * ) Notice: Subject to any disclaimer, the term of this patent is extended or adjusted under 35 U.S.C. 154(b) by 0 days.

(21) Appl. No.: 10/674,751

(22) Filed: Sep. 30, 2003

(65) Prior Publication Data

US 2005/0066621 A1 Mar. 31, 2005

(51) Int. Cl.
*E04G 21/14* (2006.01)
*E04D 5/14* (2006.01)

(52) U.S. Cl. ..... 52/746.11; 52/409; 52/410; 52/411; 156/71

(58) Field of Classification Search ..... 52/746.11, 52/746.1, 745.21, 408–412; 156/71, 91, 156/92
See application file for complete search history.

(56) References Cited

U.S. PATENT DOCUMENTS 2,176,344 A * 10/1939 Hunt ..... 52/548
3,505,770 A * 4/1970 Bennett ..... 52/309.13
4,424,650 A * 1/1984 Van Note ..... 52/96
4,441,295 A * 4/1984 Kelly ..... 52/408
4,450,663 A * 5/1984 Watkins ..... 52/309.4
4,493,175 A * 1/1985 Coppola, Jr. ..... 52/410
4,546,589 A * 10/1985 Seaman ..... 52/518
4,671,036 A * 6/1987 Sullivan ..... 52/518
4,707,961 A * 11/1987 Nunley et al. ..... 52/408
4,726,164 A * 2/1988 Reinwall et al. ..... 52/410
4,747,241 A * 5/1988 Whitman ..... 52/410
4,787,188 A * 11/1988 Murphy ..... 52/410
4,855,172 A * 8/1989 Chiu ..... 428/57
4,860,514 A * 8/1989 Kelly ..... 52/410
4,885,887 A * 12/1989 Simmons et al. ..... 52/410
4,977,720 A * 12/1990 Kuipers ..... 52/408
4,996,803 A * 3/1991 Karrfalt et al. ..... 52/96
5,018,329 A * 5/1991 Hasan et al. ..... 52/410
5,031,374 A * 7/1991 Batch et al. ..... 52/410
5,165,210 A * 11/1992 Partyka et al. ..... 52/746.11
5,171,116 A * 12/1992 Gerhardt et al. ..... 411/368
5,204,148 A * 4/1993 Alexander et al. ..... 428/41.8
5,737,897 A * 4/1998 Naipawer, III ..... 52/796.1
5,772,816 A * 6/1998 Hubbard ..... 156/71
5,797,232 A * 8/1998 Larson ..... 52/408

(Continued)

*Primary Examiner*—Robert Canfield
*Assistant Examiner*—Gay Ann Spahn
(74) *Attorney, Agent, or Firm*—Warn Hoffmann Miller & LaLone PC

(57) ABSTRACT

A single ply flexible membrane roofing system secured to a roof deck has a first membrane secured to the roof deck by fasteners. The membrane system includes a second membrane with an edge portion overlapping the first membrane edge which can be "factory" weld-bonded to the first membrane along the edge of the second membrane to provide waterproofing such that the first membrane edge projects forwardly from the bond to define a fastening projection extending forwardly from the weld bond for the laterally spaced fasteners. An adhesive coating over the fastening projection and fasteners extends essentially from the weld bond forwardly to provide a continuous adhesive coating over the first membrane projection and the fasteners to provide a substantially monolithic water-sealed seaming bond of enhanced strength with enhanced resistance to uplift forces. The invention is concerned also with the labor reduced method of constructing the system.

8 Claims, 2 Drawing Sheets

U.S. PATENT DOCUMENTS 5,800,891 A * 9/1998 Wasitis ..... 428/42.2
5,803,693 A * 9/1998 Choiniere et al. ..... 411/537
5,829,214 A * 11/1998 Hart ..... 52/302.6
5,930,969 A * 8/1999 Mayle et al. ..... 52/545
6,004,645 A * 12/1999 Hubbard ..... 428/57
6,021,616 A * 2/2000 Mayle ..... 52/408
6,055,786 A * 5/2000 Hubbard et al. ..... 52/409
6,233,889 B1 * 5/2001 Hulsey ..... 52/302.1
6,238,502 B1 * 5/2001 Hubbard ..... 156/71
6,250,034 B1 * 6/2001 Hulsey ..... 52/410
6,378,259 B1 * 4/2002 Carlson ..... 52/408
6,427,412 B1 * 8/2002 Mayle et al. ..... 52/545
6,502,360 B2 * 1/2003 Carr et al. ..... 52/408
6,537,402 B2 * 3/2003 Pate et al. ..... 156/71
6,640,511 B1 * 11/2003 Link ..... 52/410
6,689,449 B2 * 2/2004 Hasan et al. ..... 428/124
6,742,313 B2 * 6/2004 Ritland et al. ..... 52/408
6,764,260 B1 * 7/2004 Nebesnak et al. ..... 411/82
6,769,215 B1 * 8/2004 Carkner ..... 52/411
6,857,243 B2 * 2/2005 Bloomfield ..... 52/591.4
6,875,162 B2 * 4/2005 Barksdale et al. ..... 492/19
2002/0095898 A1 * 7/2002 Bettencourt ..... 52/506.05
2004/0002414 A1 * 1/2004 Barksdale et al. ..... 492/13
2004/0187420 A1 * 9/2004 Bernardi et al. ..... 52/410
2004/0187422 A1 * 9/2004 Bernardi et al. ..... 52/518
2004/0238097 A1 * 12/2004 Swann ..... 156/71

* cited by examiner

SINGLE PLY ROOFING SYSTEMS AND METHODS OF CONSTRUCTING THEM

TECHNICAL FIELD OF THE INVENTION

The invention relates to roofing systems of the type secured to generally flat roof decks and comprised of flexible synthetic membranes with overlapped and bonded edges.

BACKGROUND OF THE INVENTION

Single-ply membrane sheet roofing systems are very well recognized and widely in use as both new and renovated exterior roof surfaces for a multiplicity of building structures having generally flat roof decks. Such deck sheets today are custom prefabricated in the factory by Duro-Last, Inc., applicant's assignee, to the exact dimensions of the building roof and furnished, with weight considerations in mind, in rolled transportable sections of up to 2500 square feet to the roofer on site. Other single-ply roofs are largely worker-constructed at the site and bonded by the roofer on the site. Presently, in the case of Duro-Last, Inc. up to eighty-five percent of the field seams can be completed in the factory under ideal factory conditions, eliminating waste, saving labor, and preventing leaks. A number of such roofing systems are utilized for large footprint roofs, such as factories, administrative buildings, schools, and office buildings, for example. The present invention is concerned with improvements which are particularly suited to the more difficult-to-install systems where the number of necessary fasteners utilized, from the standpoint of labor cost, must be kept to a minimum, while still effectively performing their function.

SUMMARY OF THE INVENTION

The present invention is directed to a combination of a first membrane with a longitudinally extending free edge secured to a roof deck by fasteners and a second membrane with an edge portion overlapping the first membrane edge and factory weld-bonded to the first membrane by means of a continuous bond between the substantially very edge of the second membrane so that the first membrane edge projects forwardly from the bond to define a fastening projection or tab extending forwardly upon the roof deck.

When the second membrane is peeled upwardly, back from the bond and fastening projection, the fasteners are placed along the fastening projection to secure the fastening projection of the first membrane to the deck. With the second membrane still in peeled-back position, a fast-drying adhesive is applied over the fastening edge and fastener, from the factory bond forwardly, and provides a continuous adhesive coating from the first membrane projection over the fasteners and fastening tab or projection. Thus, a continuous monolithic bond, including the factory bond, and extending forwardly over and beyond the fastening tab and fasteners is provided in the preferred system illustrated. When the second membrane (which also preferably has its underside appropriately coated with the same adhesive) is lowered to cover the fastening projection and the deck forwardly thereof, a substantially continuous layer of material, created by the factory welding and on site adhesive coating, provides in conjunction with the mechanical fasteners a novel monolithic joint or seam.

One of the prime objects of the invention is to provide a roofing system which is exceptionally resistant to wind up-lift forces in areas of the country in which wind forces are particularly strong and hazardous to roofs.

Another object of the injection is to provide a membrane system in which the fasteners used need not be of the barbed character presently in wide use for gripping the membrane to resist wind up-lift forces.

Another object of the invention is to provide a labor-saving installation requiring a reduced number of fasteners when the roof deck is a difficult structure to roof (such as concrete) which must be drilled to receive the fasteners and is labor and cost intensive.

Another object of the invention is to provide an inexpensive, mechanically secured single-ply roofing system which is extremely durable under a wide range of wind conditions and in a variety of climates.

Another object of the invention is to provide an economically installed single-ply roofing system of reliable sealed quality which is manufactured in substantial part in the factory to ensure quality control in a sheltered working environment with specially trained employees.

Another object of the invention is to provide equal-lateral pull resistance over the fastener lap, thus uniformly spreading up-lift load through the fasteners into the deck.

Other objects and advantages of the invention will be apparent to those skilled in the art. The preferred embodiments disclosed herein are disclosed by way of example and not intended in any way to restrict the language of the claims which follow.

BRIEF DESCRIPTION OF THE DRAWINGS

These and other objects, features and advantages of the invention will become more readily apparent in view of the following detailed description, appended claims and accompanying drawings, in which:

DETAILED DESCRIPTION OF THE PREFERRED EMBODIMENTS

Referring now more particularly to the accompanying drawings, it should be understood that the roofing system, generally designated RS, and secured on roof deck D is comprised of a series of membranes, generally designated M, which are factory welded along their lapped edges to form the multiple membrane sheet, generally designated S. In FIGS. 1–4, an adjoining pair of such membranes are numbered generally 10 and 11.

Figure 1:
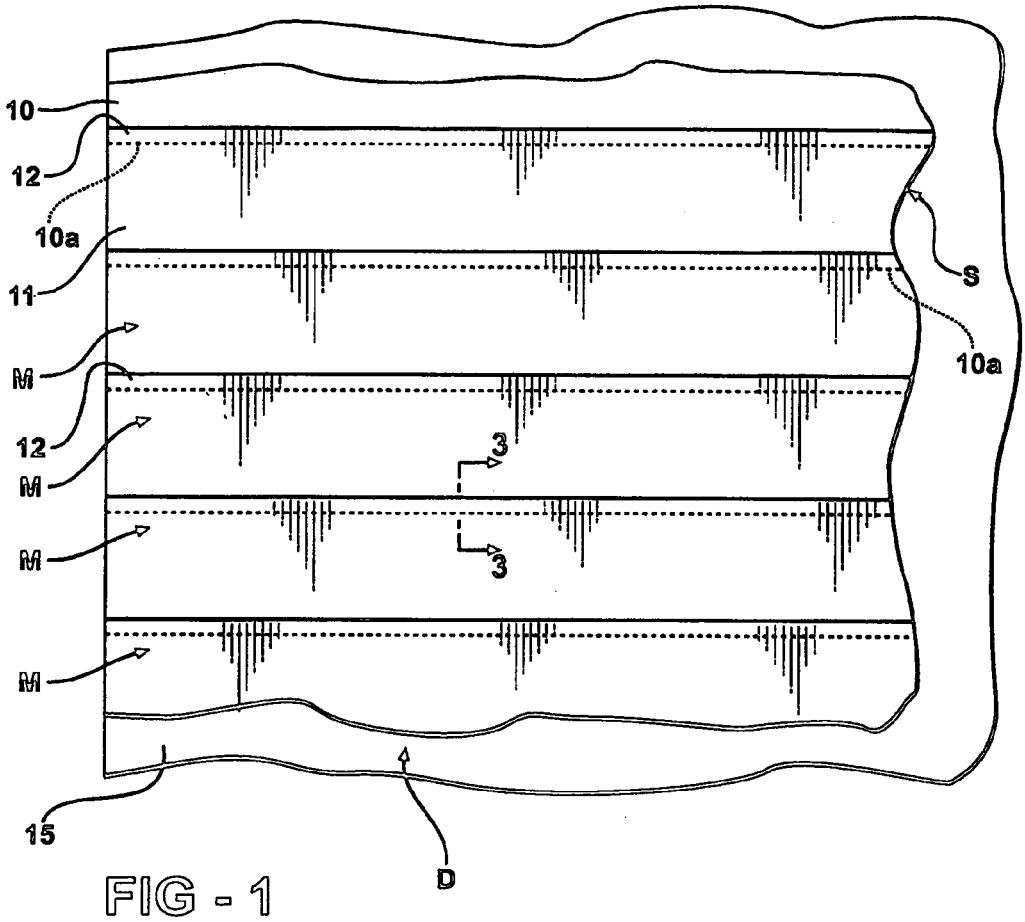
FIG. 1 is a schematic fragmentary top plan view showing part of a multiple first and second membrane sheet secured to an underlying deck structure.
Figure 2:
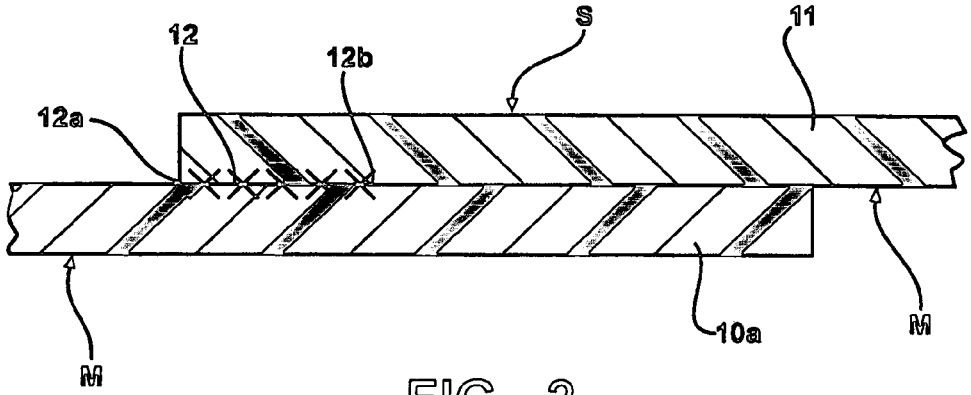
FIG. 2 is a similar view of the factory supplied roofing sheet only.
Figure 3:
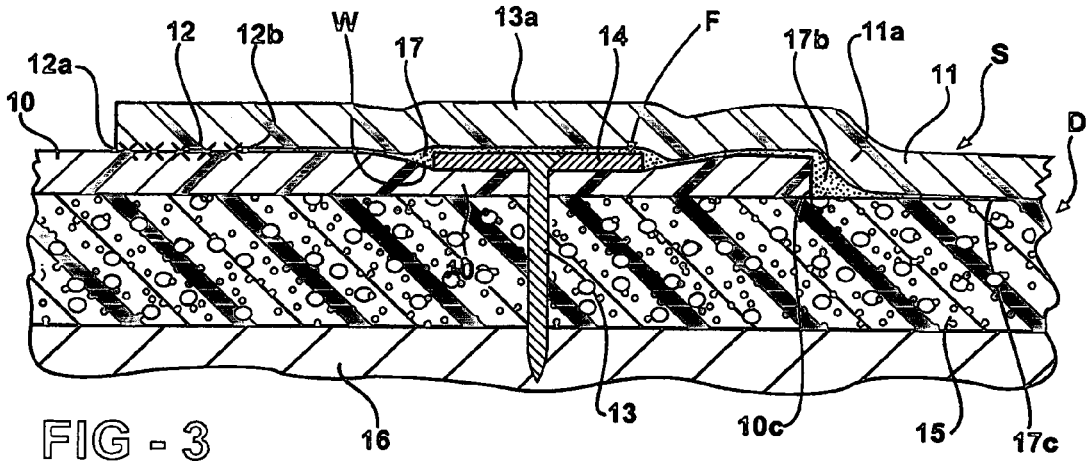
FIG. 3 is an enlarged sectional elevational view taken on the line 3—3 of FIG. 1 to illustrate a membrane system in secured position on a roof deck.
Figure 4:
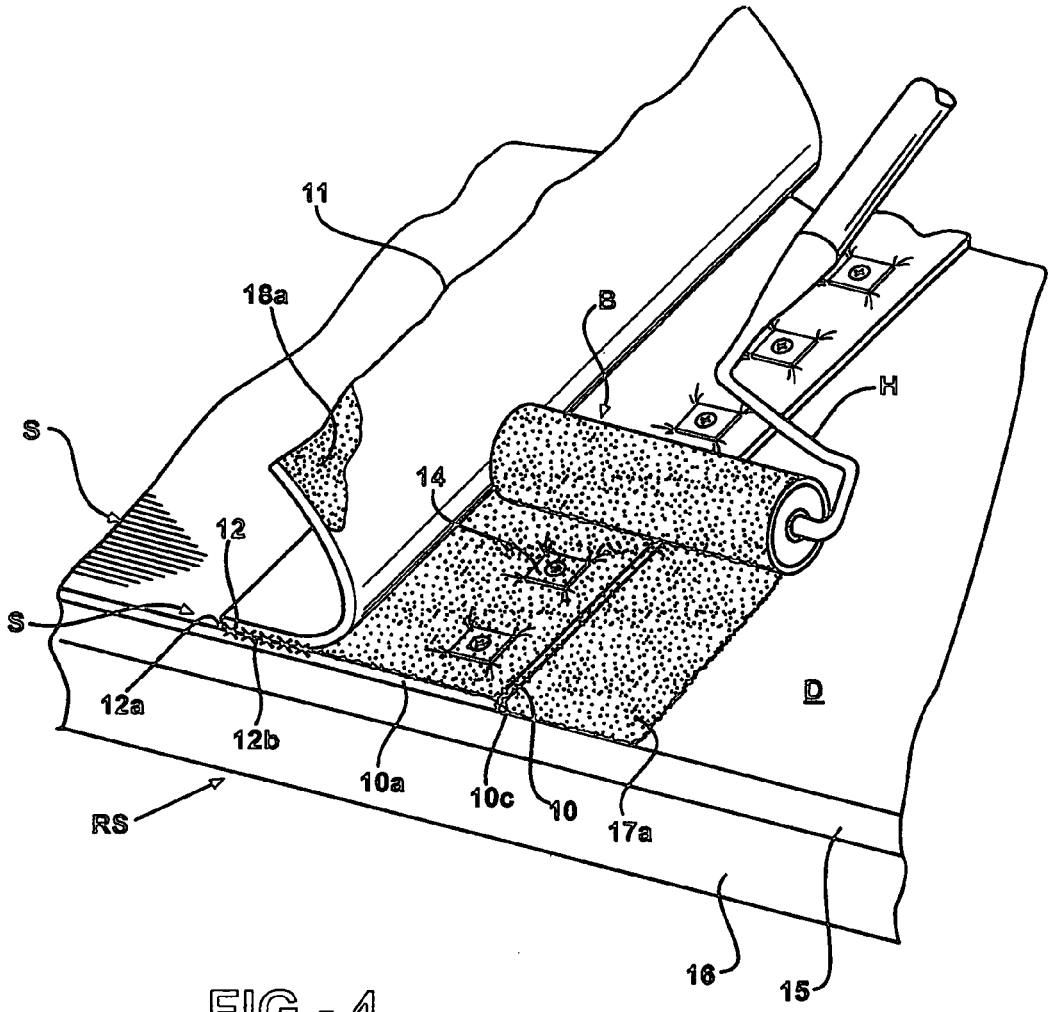
FIG. 4 is an enlarged schematic prospective elevational view illustrating a preferred method of applying the system to a roof deck.

As shown in FIGS. 2–4, the factory weld or weld bond 12 extends in a longitudinal direction from the outside edge 12*a* about an inch to the edge 12*b*. This weld can be accomplished in the factory under quality control conditions and may comprise a hot air weld effected by hot air (i.e. at a temperature of around 1200° F.) which heats the membranes 10 and 11 at the edge of membrane 11 to a welding temperature wherein their confronting thermoplastic surfaces partially melt and form a weld bond 12 of material.

The weld bond 12 may also be created by a dielectric or radio frequency welding process, or other known heat welding or bonding methods. "Factory" welds are recognized to be more reliable than hot air field welds to achieve watertight seams.

The sheet S, comprised of multiple membranes M, welded in the manner disclosed in the factory, can be supplied to the roofer in rolled sheets of, for example, 2500 square feet in the weld bonded condition shown in FIG. 2. Securement of sheet S to the roof can then take place progressively in the manner indicated in FIG. 4. With the upper membrane 11 peeled back about the welded edge 12*b*, fastener systems of fasteners F comprising fastener members, or screws 13 with heads 13*a* extending through fastener square countersunk steel load distribution plates 14 anchor the membranes of sheet S.

The roof deck D can be comprised of many known surfaces or substrates, such as concrete, wood, asphalt, coal tar, steel, cement, wood fiber and the like, and, for purposes of illustration oly, is shown in FIG. 3 as comprised of an insulation board or desk member 15 on a wood deck 16, which may be supported by suitable purlins or deck supporting structures in the conventional manner.

Once the fastener members 13 are secured in position with a suitable rotary power tool, a roller applicator or roller brush, generally designated B, having a handle H, may be used to apply a fast-drying liquid adhesive to the surface of the fastening projection or tab 10*a*, defined by the welded edge, 2*b*, forwardly and across the fastening projection 10*a* to provide a coating 17 (FIG. 3) completely covering both the fastening projection 10*a* along with the fastener system F comprising the fastener screws or members 13 with heads 13*a* and the fastener plates 14, and filling the depressed wells or cavities Win the membrane 10 along or around the fastener plates 14 shown in FIG. 3. The completely sealing coating 17 also is applied to the free edge 10*c* of the fastening projection 10*a* and to the deck member 15 forwardly of the free edge 10*c* for a predetermined distance 17*a*, i.e. six inches (6"). It is preferably applied as well as schematically shown at 18*a* in FIG. 4, to the underside of the membrane 11 from weld welded edge 12*b* forwardly for a distance so as to ultimately mate with the portion of the coating on the fastening projection 10*a* and the coating portion which extends for the predetermined distance 17*a* of the coating 17 which is provided on the deck member 15. Because the membranes 10 and 11 are sufficiently flexible, the membrane 11 folds downwardly as at 11*a* to follow the free edge 10*c* and the liquid adhesive fills the space between them as at 17*b*. Finally, as FIG. 3 indicates, the adhesive coating 17 feathers out, as at 17*c*, on the deck member 15.

As indicated previously, not only is the strip S securely fastened in position mechanically by the fastener members 13 extending through each fastening projection 10*a*, a substantially continuous monolithic bond is formed by the "factory" weld bond 12 and the "field" adhesive coating 17 to interact with the fasteners F and prevent wind lift-up forces from applying unevenly and cocking the securing fastener system F in a manner to tear the membrane. While various suitable fast-drying liquid adhesives are possible, one such adhesive which will work to secure the membranes in the field is manufactured by Sovereign Specialty Chemicals of Cincinnati, Ohio. With the present system the number of fasteners F which need be used to secure the sheet S in terms of resisting wind up-lift is considerably fewer. Resistance to membrane tearing, and membrane peeling particularly, is greatly increased and any tendency to pull the fasteners F up at cocked angles rather than straight up is considerably reduced by this monolithic structure.

METHODS OF OPERATION AND CONSTRUCTION

FIGS. 1–4 particularly disclose the method of construction of the roof system and the resulting product. Each overall sheet S is comprised of a number of adjacent membranes 10 and 11, each of which has a fastening projection 10*a* formed by overlapping an edge portion of each membrane at the joint or seam. The sheet S is applied in the manner illustrated in FIG. 4, with each of the fastening projections 10*a* successively secured in position by fasteners 13 and sealed by adhesive bonding as at 17, 17*b*, and 17*a* until the end edge of the opposite end of the sheet S shown in FIG. 4 is laid down and secured. The sheet is supplied to the site in a roll which, after the first edge is fully unwound and pealed back to expose each fastener tab 10*a*. Tautening "Grip-pull" devices of a conventional nature are used in the usual manner to remove wrinkles as the tabs 10*a* are progressively fastened and to keep each membrane taut as it is brought down to the deck to unite the adhesive on the underside of membrane 11 with the adhesive on fastening projection or tab or ledge 10*a* and over fasteners 13 and plates 14. If an edge of a sheet S is to be joined to the edge of a membrane, such as a parapet membrane, for example, it may be so joined in any acceptable manner on the site by the roofer, such as by hot-air welding of the overlapped edges with mobile implements, which are well known in the art.

Typically the membranes used may be forty mil membranes, with the membrane consisting of polyester fabric cores coated on each side with polyvinyl chloride or another thermoplastic. Duro-Last, Inc. of Saginaw, Mich., produces highly suitable membranes of this character. Various other roofing membrane sheets, including synthetic rubbers or elastomers such as EPDM and CPE, or others which may be classified as thermoplastic synthetic resins or polymers and are flexible, are believed also suited. While a membrane thickness of 0.040 inches is normal, the membrane size may, for example, be anywhere in the neighborhood of 0.030 to 0.080 in thickness, and may contain various reinforcing materials in the form of fibers or fabrics.

It should be understood that the foregoing disclosure of the invention is descriptive only of preferred forms thereof, and that the spirit and scope of the invention are to be limited only by the terms of the claims appended hereto.

I claim:

1. A method of securing a single ply membrane roofing system to a roof deck, wherein said roofing system includes a first membrane with a longitudinally extending first membrane free edge to be secured to said roof deck by transversely spaced fasteners comprising fastener members extending through fastener plates having surrounding fastener plate edge face surfaces, said roofing system having a second membrane with a second membrane edge portion overlapping said first membrane free edge and bonded to said first membrane via a continuous weld bond along the edge of said second membrane such that said first membrane free edge projects forwardly from said weld bond to define a first membrane fastening projection extending forwardly from said first membrane free edge under said second membrane, the method comprising the steps of:

a. with said roofing system applied to said roof deck and while maintaining said second membrane in a peeled back position from said weld bond and said first membrane fastening projection, placing said fastener plates and said fastener members at spaced positions into said roof deck to mechanically secure said first membrane fastening projection to said roof deck;

b. with said second membrane in said peeled back position, applying a liquid adhesive over said first membrane fastening projection and over and around said fastener plates and said fastener members from said weld bond forwardly to provide a continuous adhesive coating on said first membrane fastening projection and over said fastener members and said fastener plates and around said fastener plate edge face surfaces; and c. lowering said second membrane to cover and adhere to said first membrane fastening projection and said fasteners and provide a substantially continuous monolithic bond comprised of said weld bond and said adhesive coating.

2. The method of claim 1 wherein said adhesive coating flexibly extends down said first membrane free edge to the level of said roof deck between said first membrane free edge and the underside of said second membrane.

3. The method of claim 2 wherein said adhesive coating is extended forwardly of said first membrane free edge for a restricted distance between said second membrane and said roof deck short of the forward extent of said second membrane to accommodate a second membrane tautening procedure.

4. A method of constructing a single ply membrane roofing system applied to a roof deck, wherein said roofing system includes a first membrane with a longitudinally extending first membrane free edge to be secured to said roof deck by transversely spaced fastener systems comprising fastener members extending through fastener plates having fastener plate edge face surfaces, said roofing system having a second membrane with a second membrane free edge rearwardly overlapping said first membrane free edge and a hot air or dielectric weld bonded to said first membrane free edge via a continuous weld bond along said second membrane free edge such that said first membrane free edge projects forwardly from said weld bond to define a first membrane fastening projection, extending forwardly from said first membrane free edge, which is bordered by a first membrane fastening projection generally vertical marginal edge face surface, the method comprising the steps of:

a. with said roofing system applied to said roof deck, maintaining said second membrane in a peeled back position from said weld bond and said first membrane fastening projection and applying said fastener members and said fastener plates at transversely spaced positions to mechanically secure said first membrane fastening projection to said roof deck;

b. with said second membrane in said peeled back position, applying a fast drying liquid adhesive over said first membrane fastening projection, said fastener plates and said fastener members, and around said fastener plate edge face surface, and to extend down said first membrane fastening projection marginal edge face surface and onto only a restricted portion of said roof deck forwardly adjacent said first membrane to provide a continuous first adhesive coating on said first membrane fastening projection, said fastener plates, said fastener members, and a portion of said roof deck forwardly adjacent to said first membrane fastening projection, while also applying a second adhesive coating to the underside of said second membrane to an extent to generally cover said first adhesive coating applied to said first membrane fastening projection, said fastener plates, and said fastener members, and said roof deck; and c. lowering said second membrane to cover and join said second adhesive coating to said first adhesive coating on said first membrane fastening projection, said fastener plates and said fastener members, and to fold down along said first membrane fastening projection marginal edge face surface to capture liquid adhesive between said first membrane fastening projection marginal edge face surface and said folded down portion of said second membrane, while also adhering to a portion of said roof deck.

5. The method of claim 4 wherein said first membrane fastening projection has cavities around said fastener plate edge face surface which are filled with said first adhesive coating.

6. A method of constructing a single ply membrane roofing system applied to a roof deck, wherein said roofing system includes a first membrane with a longitudinally extending first membrane free edge to be secured to said roof deck by fasteners comprising fastener members extending through fastener plates having fastener plate edge face surfaces, said roofing system having a second membrane with a second membrane free edge rearwardly overlapping said first membrane free edge and weld bonded to said first membrane free edge via a continuous weld bond along said second membrane free edge such that said first membrane free edge projects forwardly from said weld bond under said second membrane free edge to define a first membrane fastening projection extending forwardly from said first membrane free edge which is bordered by a first membrane fastening projection generally vertical marginal edge face surface, the method comprising the steps of:

a. with said roofing system applied to said roof deck, maintaining said second membrane in a peeled back position from said weld bond and said first membrane fastening projection and applying said fastener members and said fastener plates to said roof deck to mechanically secure said first membrane fastening projection to said roof deck;

b. with said second membrane in said peeled back position, applying a fast drying liquid adhesive over said fastener plates and said fastener members, and around said fastener plate edge face surfaces, and to extend down said first membrane fastening projection marginal edge face surface to provide a continuous first adhesive coating on said first membrane fastening projection, said fastener plates and said fastener members; and c. lowering said second membrane to cover and adhere to said first adhesive coating on said first membrane fastening projection, said fastener plates and said fastener members, and folding said second membrane down along said first membrane fastening projection marginal edge face surface to capture said first adhesive coating between said first membrane fastening projection marginal edge face surface and said folded down portion of said second membrane.

7. A method for constructing a single ply membrane roofing system applied to a roof deck, wherein said roofing system includes a series of first membranes with longitudinally extending first membrane free edges to be secured to said roof deck by fasteners comprising fastener members extending through fastener plates having fastener plate generally vertical edge face surfaces, said roofing system also having a series of second membranes with second membrane free edges rearwardly overlapping said first membrane free edges and weld bonded to said first membrane free edges via continuous weld bonds along said second membrane free edges such that said first membrane free edges project forwardly from said weld bonds under said second membrane free edges to define first membrane fastening projections extending forwardly under said second membrane free edges, said first membrane fastening projections being bordered by fastener first membrane fastening projection generally vertical marginal edge face surfaces, the method comprising the steps of:

a. with said roofing system applied to said roof deck, maintaining one of said second membrane free edges in a peeled back position from one of said weld bonds and one of said first membrane fastening projections and applying one of said fastener members and one of said fastener plates to said one of said first membrane fastening projections and said roof deck to mechanically secure said first membrane fastening projection of said one of said first membranes to said roof deck;

b. with said one of said second membranes in said peeled back position applying a fast drying liquid adhesive over said fastener plate and said fastener member, and along said fastener plate edge face surface, and to extend down said first membrane fastening projection marginal edge face surface of said one of said first membrane fastening projections to provide a first adhesive coating on said one of said first membrane fastening projections, said fastener plate and said fastener member from said one of said weld bonds forwardly; and c. lowering said one of said second membranes in said peeled back position to cover and adhere to said first adhesive coating on said one of said first membrane fastener fastening projections, said one of said fastener plates and said one of said fastener members, and folding said one of said second membranes down along said one of said first membrane fastening projections marginal edge face surfaces to provide a folded down portion and capture said first adhesive coating between said one of said first membrane fastening projection marginal edge face surfaces and said folded down portion of said one of said second membranes.

8. The method of claim 7 wherein said first adhesive coating is applied to said roof deck for a restricted distance immediately adjacent said one of said first membrane fastening projection marginal edge face surfaces and short of the longitudinal length of said one of said second membranes to allow a second membrane tautening process.

* * * * *